US007509076B2

(12) United States Patent
Zona et al.

(10) Patent No.: US 7,509,076 B2
(45) Date of Patent: Mar. 24, 2009

(54) SQUAREWAVE CHARGING OF A PHOTORECEPTOR

(75) Inventors: Michael F. Zona, Holley, NY (US); Christopher A. Dirubio, Webster, NY (US); Aaron Michael Burry, West Henrietta, NY (US); Palghat S. Ramesh, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 145 days.

(21) Appl. No.: 11/683,199

(22) Filed: Mar. 7, 2007

(65) Prior Publication Data

US 2008/0219701 A1 Sep. 11, 2008

(51) Int. Cl.
*G03G 15/02* (2006.01)

(52) U.S. Cl. ..... 399/168; 399/50

(58) Field of Classification Search ..... 399/168, 399/170, 174, 175, 176, 50; 361/225; 430/902
See application file for complete search history.

(56) References Cited

U.S. PATENT DOCUMENTS

| | | | | |
|---|---|---|---|---|
| 5,742,871 | A * | 4/1998 | May et al. | 361/225 X |
| 7,024,125 | B2 | 4/2006 | Ishii et al. | |
| 2001/0043817 | A1* | 11/2001 | Maebashi | 399/50 |
| 2005/0002681 | A1 | 1/2005 | Takahashi et al. | |
| 2005/0111868 | A1 | 5/2005 | Facci et al. | |
| 2006/0222406 | A1* | 10/2006 | Facci | 399/168 |
| 2007/0092296 | A1* | 4/2007 | Ishino | 399/175 X |
| 2007/0286644 | A1* | 12/2007 | Takegawa | 399/159 |

FOREIGN PATENT DOCUMENTS

JP 2005-091683 A * 4/2005

* cited by examiner

*Primary Examiner*—Sophia S Chen
(74) *Attorney, Agent, or Firm*—Oliff & Berridge, PLC

(57) ABSTRACT

Charging devices, electrostatic imaging devices, and methods generate a charging waveform having a DC bias component and an AC component for charging the imaging surface of a charge retentive member, the AC component having a substantially squarewave waveform.

20 Claims, 7 Drawing Sheets

SQUAREWAVE CHARGING OF A PHOTORECEPTOR

BACKGROUND

The present invention relates to xerographic printing apparatus and methods, and, more specifically, relates to systems and methods that can extend the useful life of a charge receptor, such as a photoreceptor.

Conventional electrostatographic printing or reproduction apparatus, such as xerographic devices, include a print engine that utilizes a charge receptor, such as a photoreceptor (PR), to receive an electrostatic, latent image which conforms to an image desired to be produced (for example, copied or printed). Toner is then attracted to the charge receptor in amounts proportional to the localized charge of the electrostatic latent image. Thereafter, the toner is transferred to another belt or drum, or to a transfer medium such as a sheet of paper or other media.

To create an electrostatic image on the charge receptor, many xerographic engines, particularly color xerographic engines, make use of contact and/or close proximity charging devices, including biased charge rollers (BCRs). Such charging devices operate to create a sufficient voltage between the charge receptor and the BCR so that the threshold breakdown voltage, $V_{TH}$, of the air between the charging device and the charge receptor is met or exceeded. The threshold voltage varies with the particular geometry of the charging device and charge receptor. When the threshold voltage is exceeded, a corona plasma is generated in the nip region, which is the region between the charge receptor and the charging device. For contact charging devices, the nip region is the region just before the charging device and charge receptor make contact and immediately after the region the charging device and receptor make contact. The charge receptor surface is charged from the corona plasma.

Although the charging device itself may contact the charge receptor, contact is not a necessary condition for the corona to contact or reside in close proximity to the charge receptor. Further, the intense corona generation near the receptor surface can contribute to high rates of charge receptor wear.

A DC voltage may be used to drive the charging device. However, such a driving voltage does not produce a sufficiently uniform charge on the charge receptor for many applications. DC only charging devices are typically used for low end black and white machines or very short life xerographic units because of the lack of uniformity in the charge receptor charge. Thus, the conventional waveform for driving contact and/or close proximity type charging devices is an AC voltage waveform superimposed on a DC bias voltage (AC+DC charging). Conventionally, the AC voltage waveform is a sine wave. Such driving waveforms produce a charge receptor charge having superior uniformity. Additionally, such a waveform guards against contamination and provides some erase functionality. However, one significant drawback to AC+DC charging is the amount of positive corona plasma that is generated near the nip formed between the charging device and the charge receptor surface.

FIG. 1 shows a graph of a typical response of the charge receptor potential as a function of the AC peak-to-peak voltage (actuator) input to a charging device. The location of the charging device saturation point in this curve (the point at which further increases in the actuator do not significantly affect the output photoconductor charge voltage) is typically referred to as the "knee" of the charge curve, or the inflection point. In the example of FIG. 1, the knee occurs at approximately 1400 volts (V) on the AC peak-to-peak voltage axis resulting in a photoreceptor potential of approximately 750 volts. Typically, non-uniform print quality is obtained for AC charging devices when the AC peak-to-peak actuator is operated below this knee value. In addition, under certain conditions, some print quality defects may occur for actuator values close to, but above the knee of the charge curve.

One defect that can occur is the production of light and dark spots (sometimes referred to as salt-and-pepper noise) which occurs between the charging knee and a $V_{p-p}$ (peak-to-peak voltage) value known as the background disappearing point ("BDP"). The spots can be black (on white backgrounds) or white (on black backgrounds). The light and dark spots that appear as a result of the BDP defect are typically referred to as BDP spots. To prevent BDP spots from occurring, it is conventional to maintain the AC charging actuator at a $V_{P-P}$ voltage value sufficiently above the BDP. Thus, in most xerographic engines that make use of contact and/or close proximity AC charging devices, the charging actuator is operated at a value sufficiently far above the knee of the curve to ensure acceptable output print quality despite variations in the process. Generally, the BDP is 100 to 200 volts above the knee, and thus, conventionally, AC+DC charge devices are operated 200 to 400 volts above the knee. Thus, a conventional AC+DC charging waveform is a 1500 to 2500 volts peak-to-peak sinusoidal AC waveform biased by a DC voltage bias. The DC bias is chosen depending on the other xerographic subsystems, speed of the charge receptor, and type of toner material being used, but may be between −500 and −800 volts.

Because photoreceptors are typically somewhat expensive to replace, the life of these devices can have a significant impact on the overall run cost of the print engine. In fact, this can be one of the largest contributors to the parts costs for many tandem color xerographic machines.

A problem with conventional contact and/or close proximity AC charge devices operated at or above the BDP is that the rate of wear of the photoreceptor is accelerated as a result of positive ion deposition onto the photoreceptor surface by the charging device. These positive ions are believed to interact with the surface of the photoreceptor, degrading the binder molecules such as polycarbonate binder resin molecules, thereby making the photoreceptor more susceptible to abrasion and wear. It is believed that the weakening of the binder molecules results from an electrochemical interaction between the positive ions and the binder molecules, or damage due to the kinetic energy of the positive ions impinging the binder molecules. Thus, as the photoreceptor is cleaned of residual toner after image transfer by a cleaning blade, wear is accelerated. The greater the number of positive ions deposited onto the surface of the photoreceptor during charging, the more quickly the photoreceptor surface material will wear.

In addition, the larger the amount by which the charge knee voltage is exceeded, the larger the amounts of both positive and negative ions that will be produced during each cycle of the charging waveform. That is, the magnitude of the AC charging voltage applied to the charging device can significantly affect the amount of positive charge deposition that occurs on the photoreceptor surface. For a given DC offset voltage, larger peak-to-peak amplitudes for the applied AC voltage above the charging knee will typically lead to larger amounts of positive charge deposited onto the PR surface for each charging cycle. The larger the amount of positive charge deposited onto the photoreceptor surface by the charging device, the faster the PR surface will wear. Thus, it is highly desirable to minimize the distance of the charging actuator above the knee of the charge curve at all times.

In an effort to limit the amount of positive charge deposited onto the surface of the photoreceptor while maintaining acceptable output print quality, some prior methods have attempted to reduce the peak-to-peak magnitude of the AC voltage waveform in an attempt to reduce the production of positive ions. However, if reduced too much, BDP spots appear. Others attempted modulation of the AC waveform in different ways. However, many of these techniques result in difficulty with process control techniques and poor halftone uniformity in the resulting images.

Other efforts to address the need for longer life photoreceptor devices in systems with contact and/or close proximity AC charging have focused on materials related solutions. These types of approaches can include such things as improved overcoats on the photoreceptors to make them more durable. Unfortunately, these types of solutions are somewhat difficult to develop and can, in fact, cause other problems in the system. For example, creating a harder photoreceptor surface in a xerographic system with a blade cleaning device shifts the wear problems from the receptor surface to the cleaner blade edge, which can lead to reduced cleaning blade life, which might not allow a significant gain in system run cost to be realized through such a materials based solution.

Still other methods have looked at using non-contact charging devices or other subsystem changes to reduce the abrasion of the photoreceptor surface. For example, a non-contact charging device, such as a scorotron, applies high voltage to a wire or pin coronode located a distance, such as about 5 mm or more, from the photoreceptor surface. The ion generating corona discharge is localized around the coronode is such devices, not touching, but in relatively close proximity to the photoreceptor. This method of receptor charging results in generation of dysfunctional bi-products in the form of ozone and NOx, which are both harmful to the receptor and the environment in general.

Additional prior methods, such as, for example, that disclosed in U.S. Pat. No. 7,024,125, have suggested mechanisms for adjusting the charging actuator in an active fashion. However, these prior methods are limited in the information that they use to adjust the charging actuator. Such methods are typically limited to measurement of a current as a mechanism for measuring the charge level of the photoreceptor. Unfortunately, for some devices, such as biased-transfer rolls, the measurement of a current using a constant voltage mode of operation can be quite noisy. For example, if the impedance of any component changes, this can have a detrimental effect on the current measurement. In addition, prior methods typically do not make use of image quality information in their adjustment of the charging actuators. Instead, these prior systems are limited to measurements only of the underlying process parameters, namely the location of the charging knee, or threshold voltage, through measurement of a downstream current flow. While this method does give an idea of the voltage required to yield good print quality, the BDP location can't be determined reliably without feedback in the form of image quality.

Thus, there remains a need for a xerographic system with a charging device that will optimize photoreceptor life in a robust fashion while ensuring that charging related print quality defects do not occur.

SUMMARY

According to aspects described herein, there are provided electrostatographic printing and/or reproducing apparatus and methods that generate an AC voltage waveform; generate a DC voltage bias; and apply the AC voltage waveform and the DC voltage bias to an imaging surface of a charge-retentive member of the electrostatographic printing apparatus. The AC voltage waveform is in the form of a squarewave. This enables the charging voltage to be reduced, which increases the photoreceptor life.

DETAILED DESCRIPTION OF EMBODIMENTS

Figure 1:
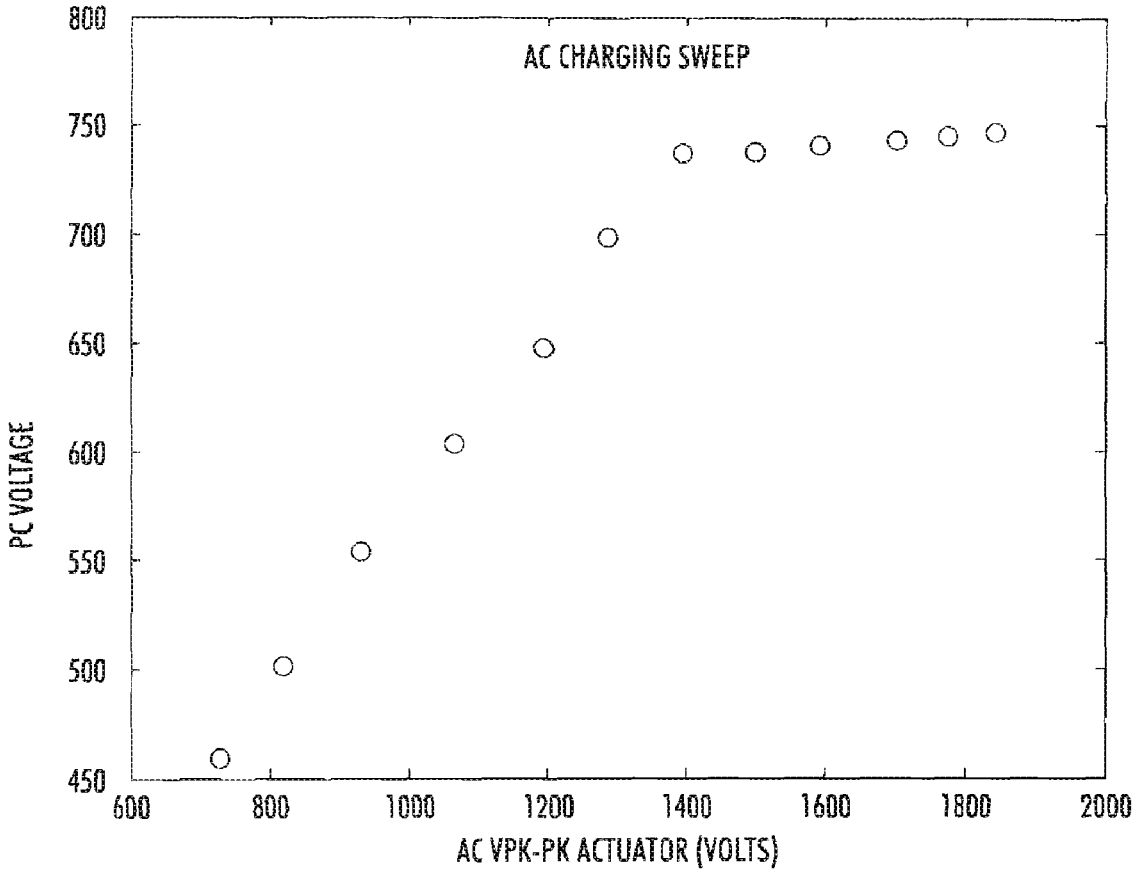
FIG. 1 is a graph showing charging device output as a function of the AC peak-to-peak voltage input to the charging device.
Figure 2:
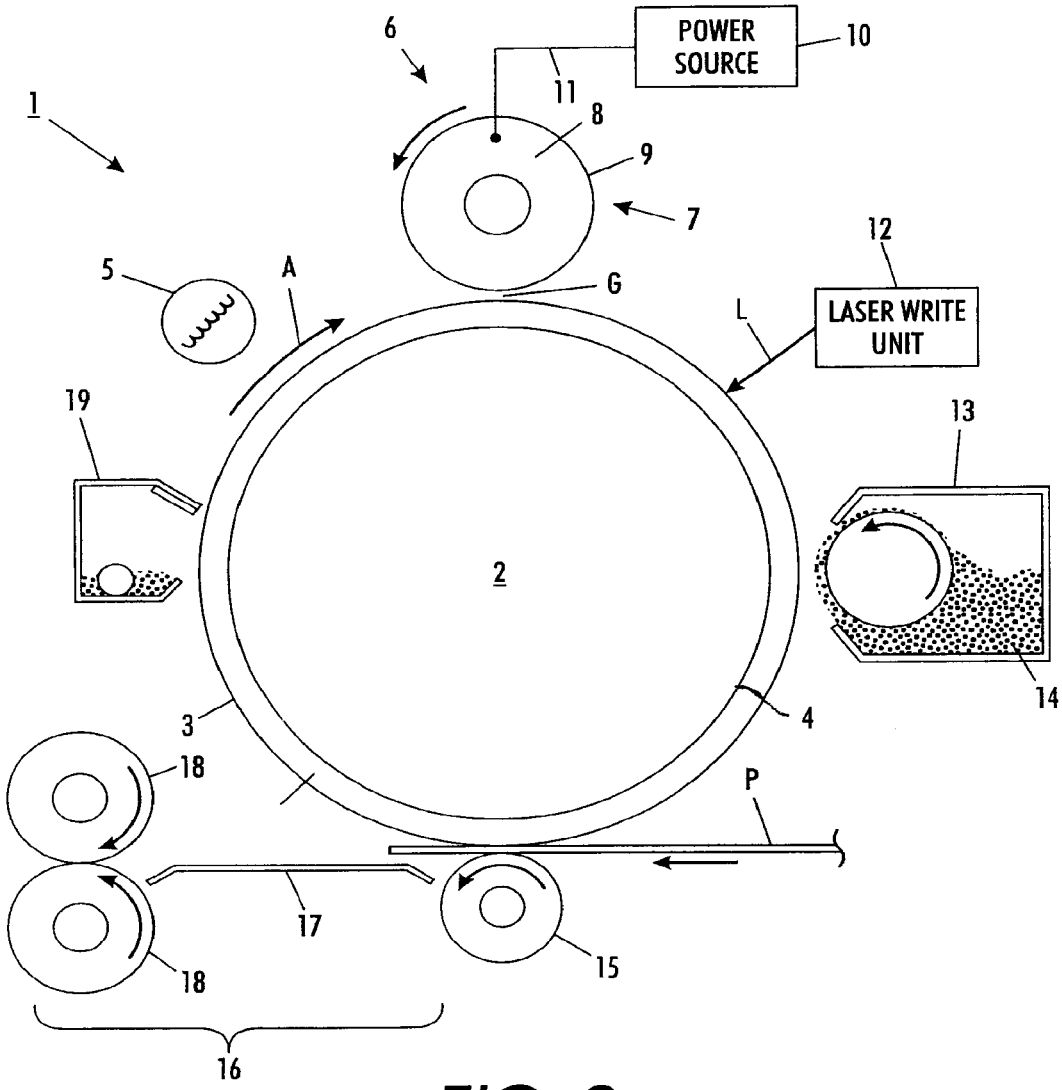
FIG. 2 shows a cross-sectional view of an image formation apparatus according to one embodiment.

FIG. 2 shows an exemplary embodiment of an image formation apparatus 1 (or print engine 1). The image formation apparatus 1 can be part of, for example, a copier, a printer, a facsimile machine, or a multifunction machine provided with at least two of these functions. Image formation apparatus 1, as shown, includes an image carrier 2; a discharge device 5; a charging device 6; a laser write unit 12; a toner deposition device 13 containing toner particles 14; a transfer roller 15; a recording medium transport 16 having guide 17 and rollers 18; and scraper 19.

Image carrier 2, in this example, includes a photoreceptor having photosensitive layer 3 laminated around a peripheral surface of a conductive base 4 on a drum or roll. In other variations, the image carrier 2 includes a belt-like photoreceptor that is wound around a plurality of rollers that are driven, or a drum-like, roll-like, or belt-like image carrier having a dielectric body.

Charging device 6 includes a charging member 7 and a power source 10. Charging member 7 can have many structures. In the current example, charging member 7 is a cylindrical biased charge roller having surface 9, and is made of a layer 8 such as stainless steel or a conductive elastomer. As shown in FIG. 2, charging member 7 is disposed opposite to the surface of the image carrier 2. In this example, there is a gap G between charging member 7 and image carrier 2. The gap G between charging member 7 and image carrier 2 can be within the range of 10 micrometers to 150 micrometers, for example. Alternatively, the gap G can be chosen relative to the tangential velocity of the surface 3 of image carrier 2. In other variations, charging member 7 and image carrier 2 can be in contact with no force between them or with a nominal force between them. In such variations the contact between the charging member 7 and the surface 3 can be continuous or periodic.

Charging member 7 is electrically connected by electrical conductor 11 to power source 10 which applies a voltage to the charging member 7. The voltage applied to the charging member 7 by power source 10 produces an electric discharge between the charging member 7 and the surface 3 of image carrier 2, resulting in the surface 3 of the image carrier 2 being charged to a predetermined voltage.

In operation, image carrier 2 is rotated in a clockwise direction as shown in FIG. 2, and its surface moves in the direction indicated by arrow A. This, in turn, the surface of the image carrier 2 is irradiated with the light from discharge lamp 5 which initializes the surface 3 of image carrier 2. Thereafter, the surface 3 of image carrier 2 is charged to a predetermined polarity and voltage by charging member 7. Next, the surface 3 of the image carrier 2 is irradiated by laser beam L emitted from laser write unit 12 and modulated according to the image to be produced. Laser write unit 12 is one example of an exposing device. As a result of the irradiation by laser beam L, an electrostatic latent image is formed on the surface 3 of the image carrier 2. Thereafter, the surface 3 of image carrier 2 passes developing device 13 where the electrostatic latent image is embodied in toner particles 14 which have been charged to a predetermined polarity and provided by developing device 13.

Next, as the image carrier 2 continues to turn, the toner image formed on the image carrier 2 is electrostatically transferred onto a transfer material P. Transfer material P can be any material able to accept the toner image from the image carrier, such as, in this example, a sheet of paper. Transfer material P is fed at a predetermined timing between the image carrier 2 and a transfer roller 15 disposed opposite to the image carrier 2. In the present example, the timing of transfer material P matches the timing of electrostatic images on image carrier 2. After receiving the toner image from image carrier 2, the transfer material P with the toner image is transferred on guide 17 and then passes between the fixing rollers 18 of fixing device 16. During this passage, the toner image is fixed onto the transfer material P by the action of, for example, heat and pressure provided by fixing rollers 18. The beat may be provided by fixing rollers 18 or can be provided by other means such as heat lamps or resistive wiring.

After the image is transferred from the image carrier 2 to a transfer material P, the image carrier 2 surface passes by scraper 19 (cleaning device) where the residual toner after transfer remaining on the surface of the image carrier 2 is removed.

Figure 3:
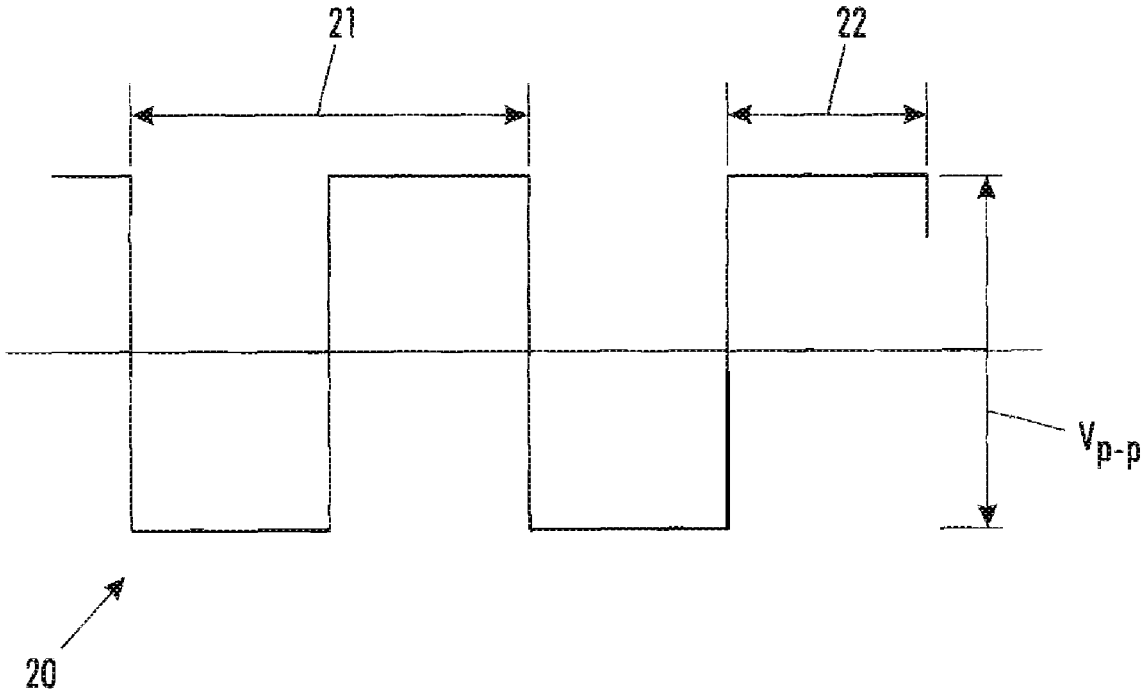
FIG. 3 shows a graph of an exemplary charging device driving waveform.

FIG. 3 shows a graph of an exemplary waveform for charging charging member 7. In variations, the voltage supplied by power supply 10 to charging member 7 is an AC voltage waveform superimposed on a DC bias voltage, wherein the AC voltage waveform is substantially a squarewave voltage waveform 20. The inventors have discovered that the use of squarewave voltage waveforms 20 to charge charging member 7 does not produce BDP spots, even at peak-to-peak voltages lower than peak-to-peak voltages of sinusoidal or other waveforms at levels that do produce BDP spots. Additionally, while lower peak-to-peak voltages are possible with squarewave waveform 20, squarewave waveform 20 maintains superior charge uniformity on photoreceptor surfaces. Since a squarewave voltage can be used at lower voltages without having the ill effects of BDP stops, the amount of positive charge deposition can be lowered, thereby reducing the wear of the charge receptor. This allows for significant life extension of the photoreceptor surface enabling a reduction in run cost for products utilizing print engines. Additionally, the extension of run life of the photoreceptor surface translates to lower intervention rates for maintenance or servicing. Thus, printing engines utilizing squarewave waveform 20 to drive the charging device can be used in tightly integrated parallel process (TIPP) architectures.

As shown in FIG. 3, squarewave voltage waveform 20 has a period 21, a pulse width 22, and a peak-to-peak voltage $V_{P\text{-}P}$. The duty cycle of the squarewave voltage waveform 20 is defined as 100% multiplied by pulse width 22 and divided by period 21. The frequency of the squarewave voltage waveform 20 is defined as the inverse of the period 21. In variations of the current example, the duty cycle of squarewave voltage waveform 20 is chosen in the range of 20% to 60%, or more preferably 20% to 40%.

In variations of this example, the gap G is 100 micrometers and the movement rate v (mm/sec) of the surface of the image carrier 2 is 200 mm/sec the peak-to-peak voltage Vp-p of the AC voltage applied to the charging member 7 is 2 KV, for example, and the frequency f(Hz) of the AC voltage is 1600 Hz. However, narrower or wider gaps can be used, including contact charging where the gap is 0. Depending on the process speed of the charge receptor, the AC peak to peak voltage may be in the range of 1000 to 2500 volts, while the frequency can range from 1000 to 5000 Hz. Further, in various exemplary embodiments, the DC voltage applied to the charging member 7 is in the range of −450V to −800V. Based on these settings, in various exemplary embodiments the surface of the image carrier is uniformly charged to a value close to the applied DC bias voltage, such as −450 to −800 volts. As described previously, however, the voltage necessary to achieve the threshold voltage is a function of the geometry of the charging member and the image carrier 2. Thus, the most suitable DC bias voltage will vary with the geometry of the charging member 7 and the image carrier 2, as well as the toner charge in the development and process speed of the charge receptor.

Figure 4:
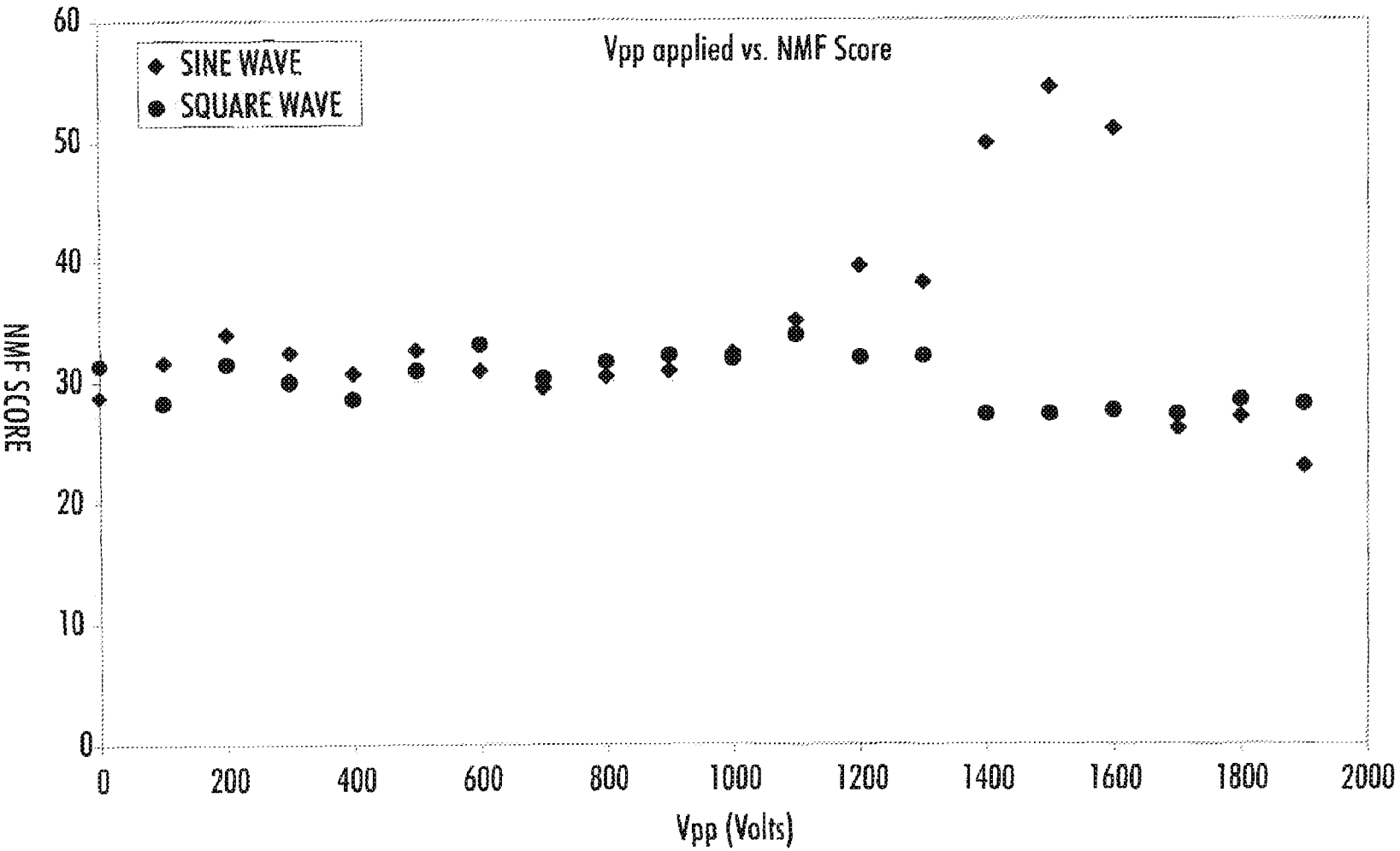
FIG. 4 shows a graph of NMF score as a function of Vp-p for sine and squarewave waveforms.
Figure 5:
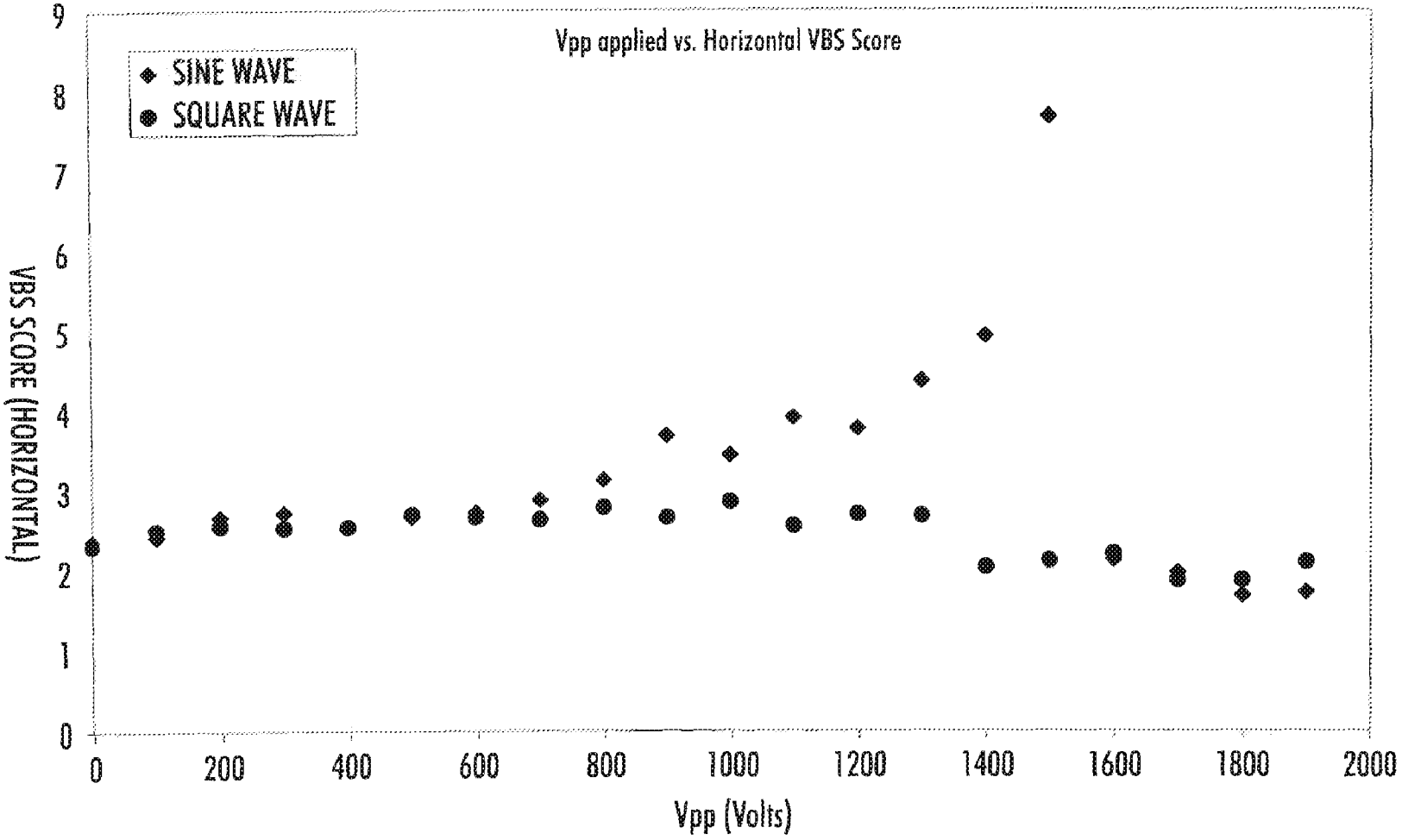
FIG. 5 shows a graph of VBS score as a function of Vp-p for sine and squarewave waveforms.

FIG. 4 shows a graph of Noise at Mottle Frequency (NMF) score as a function of Vp-p for sine and squarewave waveforms, and FIG. 5 shows a graph of Vertical Banding Score (VBS) as a function of Vp-p for sine and squarewave waveforms. NMF and VBS scores are two metrics used to evaluate the uniformity of a halftone area. NMF is a metric for lightness variation in a halftone, while VBS measures the streaks in a halftone area, perpendicular to the process direction. Lower scores in both metrics mean superior halftone uniformity. Both figures show the knee of the charging curve and the point where BDP spots disappear in the sine wave case. In the case of a sine wave waveform, the BDP spots create very non-uniform halftones as the peak-to-peak voltage approaches the inflection point and does not improve until 200-300 volts above the inflection point. In the case of a squarewave waveform, the halftone uniformity is stable below and above the inflection point and shows no signs of BDP spot production, even at low peak-to-peak voltage. Thus, the graphs of FIGS. 4 and 5 demonstrate that a squarewave waveform is superior to a sine wave waveform in that it does not require higher $V_{P\text{-}P}$ voltages (that is, above the knee (inflection point)) in order to avoid BDP formation. Accordingly, charge receptor degradation is reduced by using a squarewave waveform for the AC voltage portion of the waveform applied to the charging member of the charging device 6.

Figure 6:
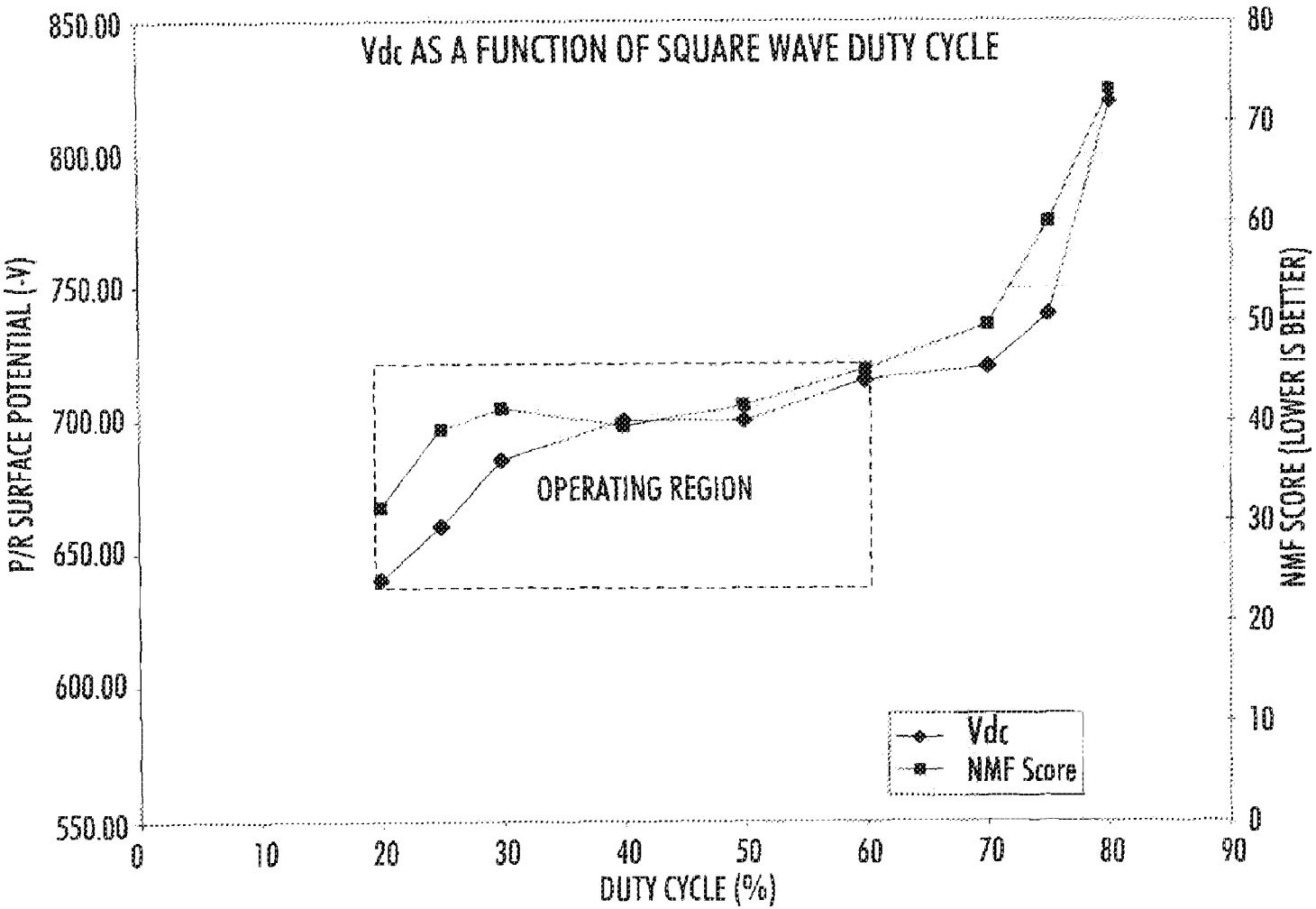
FIG. 6 shows a graph of photoreceptor surface potential as a function of duty cycle for an exemplary charging device waveform.

FIG. 6 shows a graph of photoreceptor surface potential as a function of duty cycle for an exemplary charging device waveform. The duty cycle for squarewave waveform 20 is preferably between 20% and 60%, and more preferably between 20% and 40%, to provide superior halftone uniformity. Adjusting the duty cycle of squarewave waveform 20 results in a 70-80 volt shift in the measured surface potential of the photoreceptor drum or belt, while not compromising the halftone uniformity as measured by NMF. This allows the final voltage of the charge receptor to be adjusted based on the duty cycle of the applied charge voltage squarewave. The final voltage of the photoreceptor is typically used as an actuator in a xerographic system to maintain consistant image density. The duty cycle then becomes the actuator for maintaining image density. Thus, use of squarewave waveform 20 allows for the reduction of AC peak-to-peak voltage to prevent excessive positive charge deposition and allows for longer life of the photoreceptor surface. Further, it allows the addition of an actuator for process control to adjust the final voltage, $V_{high}$, of a xerographic system.

Figure 7:
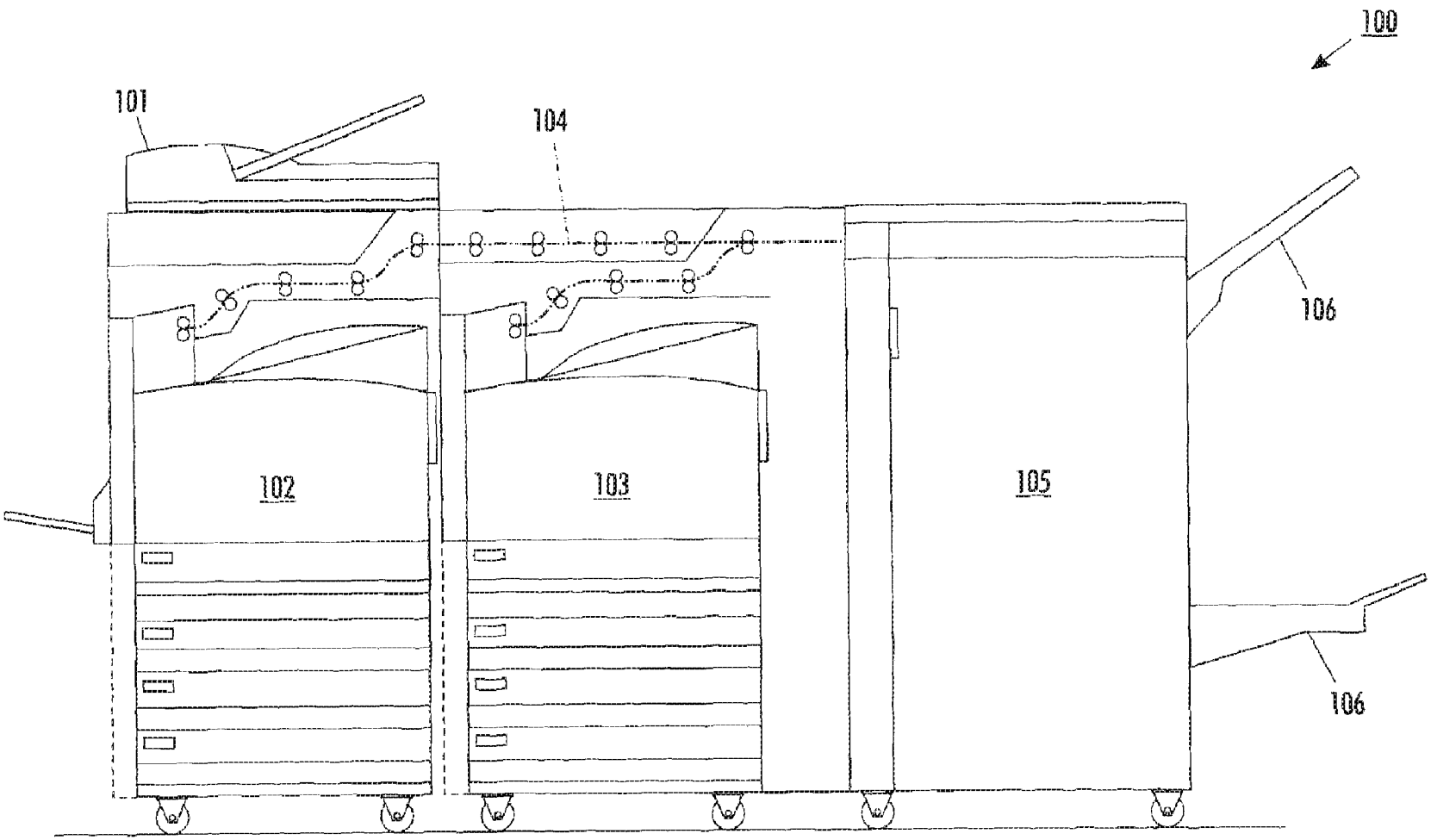
FIG. 7 shows a xerographic device incorporating an exemplary print engine.

FIG. 7 shows a xerographic device 100 incorporating an exemplary print engine according to the preceding examples. Xerographic device 100 includes, for example, image input device 101, image creation devices 102 and 103 including transport path 104 able to take a recording medium to one or more print engines as described in the preceding examples. The finisher 105 receives transported recording mediums from the transport path 104 and outputs the recording mediums into either of output bins 106.

It will be appreciated that various of the above-described and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed.

What is claimed is:

1. A method of charging a charge-retentive member of an electrostatographic imaging apparatus, the electrostatographic imaging apparatus including a charging device for placing a charge on an imaging surface of the charge-retentive member, the method comprising:

generating an AC voltage signal having a substantially squarewave waveform;

generating a DC voltage bias;

applying, by the charging device, the AC voltage waveform and the DC voltage bias to the charge-retentive member of the electrostatographic imaging apparatus; and adjusting a duty cycle of the squarewave waveform in order to control an amount of charge produced on the charge-retentive member and an image density of images produced by the electrostatographic imaging apparatus.

2. The method of claim 1, wherein the applying step causes the imaging surface to become uniformly charged.

3. The method of claim 1, wherein the DC voltage bias is in the range of approximately −400 to −800 volts DC.

4. The method of claim 1, wherein the AC voltage waveform is in the range of approximately 1000 to 2500 volts peak-to-peak.

5. The method of claim 1, wherein the AC voltage waveform has a frequency between approximately 500 and 5000 Hertz.

6. The method of claim 1, wherein the duty cycle is between approximately 20% and 60%.

7. The method of claim 6, wherein the duty cycle is between approximately 20% and 40%.

8. The method of claim 1, wherein a useful life of the charge-retentive member is prolonged over the useful life if a non-squarewave AC voltage signal is used to charge the charge-retentive member.

9. A method of charging a charge-retentive member of an electrostatographic imaging apparatus, the electrostatographic imaging apparatus including a charging device for placing a charge on an imaging surface of the charge-retentive member, the method comprising:

generating an AC voltage signal having a squarewave waveform;

generating a DC voltage bias; and applying, by the charging device, the AC voltage waveform and the DC voltage bias to the charge-retentive member, wherein the AC voltage signal has a duty cycle between approximately 20% and 40%.

10. The method of claim 9, wherein the DC voltage bias is in the range of approximately −400 to −800 volts DC.

11. The method of claim 9, wherein the AC voltage waveform is in the range of approximately 1000 to 2500 volts peak-to-peak.

12. The method of claim 9, the method further comprising:

adjusting the duty cycle in order to control an amount of charge produced on the charge-retentive member and an image density of images produced by the electrostatographic imaging apparatus.

13. The method of claim 9, wherein the applying step causes the imaging surface to become uniformly charged.

14. The method of claim 9, wherein a useful life of the charge-retentive member is prolonged over the useful life if a non-squarewave AC voltage signal is used to charge the charge-retentive member.

15. An electrostatographic imaging apparatus comprising:

a charge-retentive member having an imaging surface; and a charging device that places a charge on the imaging surface, the charging device comprising:

a charging member, and a power source that generates a charging waveform that has a DC bias component and an AC component, the AC component having a substantially squarewave waveform, the power source being electrically coupled to the charging member such that the charging device receives the charging waveform, the power source including:

circuitry that varies a duty cycle of the squarewave waveform in order to control an amount of charge produced on the charge-retentive member and an image density of images produced by the electrostatographic imaging apparatus, wherein the charging device uniformly charges the imaging surface when the charging device receives the charging waveform.

16. An electrostatographic imaging apparatus according to claim 15, wherein the DC bias component is in the range of approximately −400 to −800 volts DC.

17. An electrostatographic imaging apparatus according to claim 15, wherein the AC component is a waveform in the range of approximately 1000 to 2500 volts peak-to-peak.

18. An electrostatographic imaging apparatus according to claim 15, wherein the AC component has a frequency between approximately 500 and 5000 Hertz.

19. An electrostatographic imaging apparatus according to claim 15, wherein the duty cycle is between approximately 20% and 60%.

20. An electrostatographic imaging apparatus according to claim 19, wherein the duty cycle is between approximately 20% and 40%.

* * * * *